US006550389B1

(12) United States Patent
Goto et al.

(10) Patent No.: US 6,550,389 B1
(45) Date of Patent: Apr. 22, 2003

(54) PRINTING METHOD FOR PRINTING ON CAN BARREL

(75) Inventors: Hiroaki Goto, Tokyo (JP); Shigenobu Murakami, Kanagawa (JP); Yasuhiro Takasaki, Kanagawa (JP); Shinji Yamada, Kanagawa (JP); Tooru Shimomura, Tokyo (JP); Katsuyuki Hirata, Kanagawa (JP); Shinya Otsuka, Kanagawa (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 09/626,796

(22) Filed: Jul. 26, 2000

(30) Foreign Application Priority Data

Jul. 27, 1999 (JP) ..... 11-212223

(51) Int. Cl.[7] ..... B41C 47/60; B41C 47/14; B31F 1/07; B41F 17/08; B41M 5/00

(52) U.S. Cl. ..... 101/483; 101/40; 101/404; 101/31.26; 101/465; 101/477

(58) Field of Search ..... 101/40, 483, 465, 101/404, 31.26; 106/486

(56) References Cited

U.S. PATENT DOCUMENTS

| | | | | | |
|---|---|---|---|---|---|
| 3,837,275 | A | * | 9/1974 | Madsen | 101/23 |
| 4,384,518 | A | * | 5/1983 | Albin | 101/40 |
| 5,480,481 | A | * | 1/1996 | Setoguchi et al. | 106/404 |
| 5,671,678 | A | * | 9/1997 | Bolte et al. | 101/491 |
| 5,779,777 | A | * | 7/1998 | Okuda et al. | 106/31.26 |
| 5,910,388 | A | * | 6/1999 | Ray et al. | 430/110 |
| 5,970,865 | A | * | 10/1999 | Horth et al. | 101/40 |
| 6,098,545 | A | * | 8/2000 | Kato | 101/465 |
| RE36,911 | E | * | 10/2000 | Hieda | 106/404 |
| 6,190,744 | B1 | * | 2/2001 | Akao et al. | 428/34.2 |
| 6,193,799 | B1 | * | 2/2001 | Eriksson | 118/261 |
| 6,233,424 | B1 | * | 5/2001 | Mohri et al. | 399/320 |

* cited by examiner

*Primary Examiner*—Andrew H. Hirshfeld
*Assistant Examiner*—Marvin P Crenshaw
(74) *Attorney, Agent, or Firm*—Sughrue Mion, PLLC

(57) ABSTRACT

A printing method for printing an ink layer on a can barrel. The method includes picking-up a bright ink containing at least one bright pigment having an average particle size of from 5 to 25 μm selected from the group consisting of aluminum flake and fine particulate coated pearl pigment from an engraving roller, feeding the picked-up ink to a printing plate directly or via a rubber roller, and applying the ink on the printing plate to a can barrel via a blanket wheel.

11 Claims, 2 Drawing Sheets

PRINTING METHOD FOR PRINTING ON CAN BARREL

FIELD OF THE INVENTION

The present invention relates to a method for printing on a can barrel such as a two-piece can. More specifically, the present invention relates to a printing method for printing on a can barrel, ensuring good transferability of bright ink, and providing print having a bright feeling and high image and line reproducibility.

BACKGROUND OF THE INVENTION

Various printing is applied to the outer surface of a metal can so as to display the contents, an image thereof or a design informing the origin thereof, or to increase its commercial value.

The printed can has a cross-sectional structure, for example, as shown in FIG. 1 (known example), including a metal substrate 1. An undercoat layer 2 called white or size, a printing ink layer 3 and a finishing varnish layer 4 are sequentially provided on the outer surface of the can.

For the printing ink layer, an ink containing a bright pigment such as aluminum flake or fine particulate coated pearl pigment is used so as to impart brightness in some cases.

Also, it is already known to form a can barrel using a metal blank for the can formation after laminating thereon a gravure printed film. For example, JP-A-7-41740 (the term "JP-A" as used herein means an "unexamined published Japanese patent application") describes a polyester film for coating a can material, which is heat-bonded to a metal sheet for a can material via a thermosetting resin-type adhesive to form a protective coating layer. A printed layer comprising a resin composition containing a pearl pigment is provided by gravure printing on one surface of the polyester film and a thermosetting resin-type adhesive is provided on the printed layer.

In the former printed can, the printing ink layer is generally applied to the surface of the can body by an offset system. However, in the case of an ink containing a bright pigment, the dispersion median diameter of the bright pigment in the ink is as small as less than 5 $\mu$m. Therefore, the ink layer can have only a low degree of brightness, and the ornamental effect thereby obtained is not satisfactory.

A first reason therefor is that when a bright pigment having a large particle size is used, the bright pigment gathers at the corner of a roller during the transfer of ink and the transfer does not proceed smoothly. Therefore, a bright pigment having a small particle size must be used. Another reason is that the printing ink is kneaded by a roller so as to reduce the median diameter thereof.

In the latter printed can, high brightness may be attained, but the procedure is complicated. Furthermore, when the polyester film is applied to a two-piece can, workability of the film wrap part is troublesome.

The present inventors have carried out extensive investigations to identify the factors which can realize excellent transferability of the bright ink, high brightness and good reproducibility of images and lines even in the case of applying a printing ink containing a bright pigment onto the outer surface of a can by an offset system. As a result, the present inventors found that it is important to select a bright pigment having a relatively large particle size, and to use a engraving roller for picking up the bright ink.

SUMMARY OF THE INVENTION

It is therefore a first object of the present invention to provide a printing method for printing on a can barrel using an offset system, which can ensure excellent transferability of bright ink, and which can provide bright print having high image and line reproducibility.

Another object of the present invention is to provide a method for forming a clear and high-quality printed image on the surface of a can barrel without generating transfer failure of the ink, thickening of the image or non-image areas or staining even when a plurality of inks having different properties such as different viscosities are applied.

According to the present invention, a printing method for printing an ink layer on a can barrel is provided, which comprises picking up a bright ink containing at least one bright pigment having an average particle size of from 5 to 25 $\mu$m selected from the group consisting of aluminum flake and fine particulate coated pearl pigment from an engraving roller, feeding the picked-up ink to a printing plate directly or via a rubber roller, and applying the ink on the printing plate to a can barrel via a blanket wheel.

In preferred embodiments of the printing method of the present invention, 1. the bright ink has a viscosity of 20 poise or less at a temperature of 35° C. and a shear rate of 100 $sec^{-1}$;
2. the printing plate is a relief printing plate, and the method comprises forming an ink layer on the can barrel without applying dampening water onto the printing plate (that is, dampening water is not applied to the printing plate during the printing operation);
3. the printing plate has a JISA hardness of 90° or less;
4. the rubber roller has a JISA hardness of 60° or less;
5. the method comprises feeding the picked-up ink on the engraving roller to the printing plate via a rubber roller, rotating the engraving roller and rubber roller each at respective peripheral speeds, and varying the peripheral speed of the rubber roller relative to that of the engraving roller; and
6. varying the peripheral speed ratio (Vr/Va) within the range of from 0.5 to 1.5, where Vr is the peripheral speed of the rubber roller and Va is the peripheral speed of the engraving roller.

The present invention can be easily applied to multicolor printing. In this case, a multiple roller-type inker is preferably disposed in the periphery of the blanket wheel and pasted inks are fed to a common blanket wheel from the printing plate of the multiple roller-type inker, to thereby perform multicolor printing on a can barrel.

DESCRIPTION OF THE PREFERRED EMBODIMENTS

Operation

Figure 1:
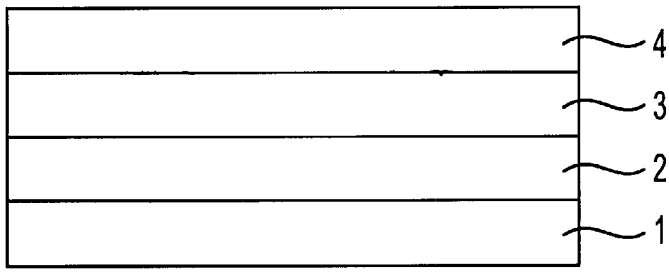
FIG. 1 is a view showing a cross-sectional structure of a printed can.

The printing method for printing on a can barrel of the present invention, where the printing is performed by an offset system using a bright ink containing at least one bright pigment selected from the group consisting of aluminum flake and fine particulate coated pearl pigment, is characterized in that the bright pigment has an average particle size of from 5 to 25 $\mu$m, the bright ink is picked up by an engraving roller, the picked-up ink is fed to the printing plate directly or via a rubber roller, and the ink on the printing plate is applied onto a can barrel via a blanket wheel.

On entering of light, the aluminum flake pigment present in the printing ink layer imparts metallic reflected light, namely, axially reflected light, and the nacreous pigment (particulate coated pearl pigment) gives a certain interference color light due to multiple reflection. These pigments are common in that a bright appearance is imparted to the printed ink layer.

However, it was found that the bright feeling of the printing ink containing the above-described bright pigment is closely related to the average particle size of the bright pigment and on consideration of the bright feeling, it is important to use a bright pigment having an average particle size of from 5 to 25 $\mu$m. More specifically, the present inventors verified that if the average particle size is less than the above range, the printing ink layer as a whole is liable to darken thereby resulting in insufficient brightness, whereas if the average particle size exceeds the above-described range, an excessively large difference of reflection results between those areas having the bright pigment and those areas not having the bright pigment and well-balanced brightness cannot be obtained. On the other hand, with a bright pigment having an average particle size within the above-described range, a clear and well-balanced bright feeling is obtained.

The use of an ink containing a bright pigment having a relatively large particle size, however, was found to incur many problems in offset printing.

First, even when a bright pigment having an average particle size within the above-described range is used, a problem arises in that the pigment particle is broken during the printing or only pigment particles having a small particle size are transferred, failing to ensure the presence of pigment particles having a particle size within the above-described range in the printed ink layer.

Second, the printing ink containing bright pigment particles is not necessarily favored with satisfactory transferability at printing. Therefore, transfer failure of the ink readily occurs in conventional printing systems on a can barrel, such as mal-transfer to the printing plate or uneven transfer.

Third, the printing ink containing a bright pigment is liable to gather in the non-image areas on the printing plate and has a problem in that the image areas do not have sufficiently high reproducibility. For example, the image area may be thickened.

These problems can be solved by the present invention where a bright ink containing a bright pigment having an average particle size within the above-descried range is picked up by an engraving roller, the picked-up ink is fed to a printing plate directly or via a rubber roller, and the ink on the printing plate is applied to a can barrel via a blanket wheel.

The engraving roller in general is a roller having on the surface thereof a large number of recessions formed by an etching method or an engraving method. The engraving roller preferably has a construction such that two groups of parallel lines spaced at a constant distance run to intersect each other, and a large number of micro-holes having a trapezoidal section are formed in a lattice defined by the parallel lines. Other than this, the engraving roller has a construction such that a large number of diagonal grooves are formed on the surface.

The transferability of the bright ink and on printing, the bright feeling and the image reproducibility are improved when the above-described engraving roller is used. This seems to result because of the following reasons, although the present invention is not at all restricted thereto.

In this engraving roller, the ink including the bright pigment is held in the above-described holes. This prevents the pigment particle from breaking upon picking up or transferring the ink. Furthermore, the ink is uniformly present on the roller surface, so that the transfer can proceed impartially and relatively uniformly. Also, the uniform transfer can prevent thickening of the image part.

The bright ink for use in the present invention preferably has a viscosity of 20 poise or less at a temperature of 35° C. and a shear rate of 100 $sec^{-1}$.

As described above, the bright ink readily gathers in the non-image areas on the printing plate to cause thickening of the image areas. The use of an ink having a low viscosity is effective for preventing thickening of the image areas, and specifically, by using an ink having a viscosity within the above-described range, the reproducibility of the image areas can be improved.

The printing plate for use in the present invention is preferably a relief printing plate, and the ink layer is preferably formed without applying dampening water onto the printing plate.

In general, the printing plate used in the offset printing is a printing plate having a lipophilic ink-receiving face and a hydrophilic non-image face. Dampening water is applied to the printing plate in advance of the transfer of ink. This application of dampening water is advantageous in that it makes it difficult for the ink to spread, and a cooling effect is realized. But in turn, problems are liable to occur, for example, the ink may become emulsified due to mingling of water or the image may become blurred. In addition, the use of dampening water is disadvantageous in that a large inker unit is necessary, or the printing speed cannot be readily increased.

In the present invention, a pick-up system using an engraving roller is employed, so that even when a relief printing plate is used, the degree of filling in the non-image areas is small. Furthermore, dampening water is not applied and this is advantageous in that problems such as emulsification of the ink or image blurring can be eliminated, the inker unit can assume a small size, and the printing speed can be increased.

The printing plate for use in the present invention has a predetermined preferred range with respect to the transfer of the bright ink, and a printing plate having a JISA hardness of 90° or less is preferred (JIS K 6253-1993: "Hardness testing methods for vulcanized rubber"). If the hardness of the printing plate exceeds the above-described range, the bright pigment is liable to accumulate on the printing plate. With the use of a printing plate having a hardness within the above-described range, such a tendency can be prevented.

In the case where the ink picked-up by an engraving roller is fed to a printing plate via a rubber roller, the rubber roller used preferably has a JISA hardness of 60° or less. By using a rubber roller having a hardness within this range, the transfer of the ink from the rubber roller to the printing plate can proceed smoothly.

In one embodiment of the present invention, the ink on the engraving roller is fed to a printing plate via a rubber roller, and the peripheral speed ratio between the rubber roller and the engraving roller is changed, whereby the amount of the ink transferred to the printing plate can be controlled.

The Examples below confirm that when the peripheral speed ratio between the rubber roller and the engraving roller is 1, the amount of transferred ink is at a maximum and as the peripheral speed ratio deviates from 1, the amount of transferred ink decreases (see, e.g., Examples 3 to 5).

When the peripheral speed of the rubber roller is given as Vr and the peripheral speed of the engraving roller is given as Va, for controlling the transferred amount of the ink, the peripheral speed ratio (Vr/Va) is preferably varied within the range of from 0.5 to 1.5.

The present invention, in which the ink containing a bright pigment is picked up by an engraving roller and the ink on the printing plate is fed to a can barrel via a blanket wheel, can be easily applied to multicolor printing by using a pasted ink (paste ink used for relief printing or lithography) in combination with the above-described ink. See, for example, K. Igarashi and N. Noguchi, "Pigment Dispersion in Printing Inks", Dainippon Ink and Chemicals, Inc. (1997).

In this case, a multiple roller-type inker is disposed in the periphery of the blanket wheel and pasted inks are fed to the common blanket wheel from the printing plate of the multiple roller-type inker to perform multiple printing on a can barrel.

In using a high-viscosity ink such as a pasted ink, a multiple roller-type inker is advantageously used in view of uniform transfer of the ink to a printing plate. This pasted ink is also advantageous in that thickening of the image can be prevented upon transfer from the printing plate to a blanket and also upon transfer from the blanket to a can.

In this embodiment of the present invention, the bright ink from the engraving roller and the pasted ink from the multiple roller-type inker are fed to a common blanket wheel. As a result the thickening of the image (first-stage thickening) due to gathering of the ink on a printing plate, particularly in the non-image areas of a relief printing plate, and the thickening of the image (second-stage thickening) upon transfer from the printing plate to a blanket and upon transfer from the blanket to a can, can both be prevented and the reproducibility of the image areas can be remarkably improved.

Apparatus Used in the Printing Method

Figure 2:
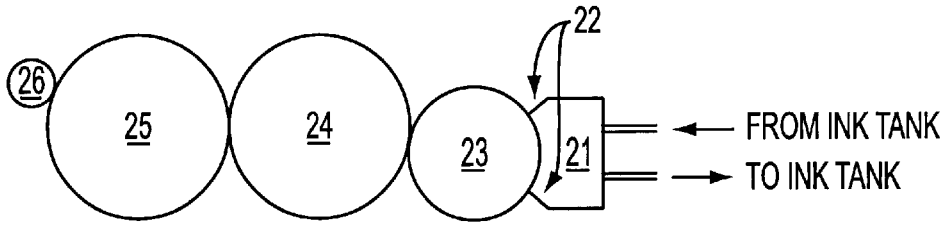
FIG. 2 is a schematic view of a printer used in Example 1.

FIG. 2 is a view showing one example of the disposition of components in a printer for use in the present invention. This printer comprises three rollers including an engraving roller 23, a plate cylinder 24 and a blanket wheel 25, and is designed such that the rollers all are driven in the forward direction and rotate at the same peripheral speed when a printing plate and a blanket each having a predetermined thickness are fixed to the plate cylinder and the blanket wheel, respectively.

The ink is fed from a chamber-type ink feeding unit 21 with doctor blades 22, and the doctor blade is disposed to contact the engraving roller.

The pressure between the engraving roller 23 and the printing plate on the plate cylinder 24 and the pressure between the printing plate and the blanket on the blanket wheel 25 are set to provide a nearly kiss touch state to the extent possible within a range of not generating pressure unevenness or pressure relief.

The bright ink is picked up by the engraving roller 23 from the ink feeding unit 21 and fed to the printing plate. Subsequently, the ink in the image area of the printing plate is transferred to the blanket and further transferred to a thin-wall seamless can mounted on a mandrel 26, to thereby obtain a printed can.

Figure 3:
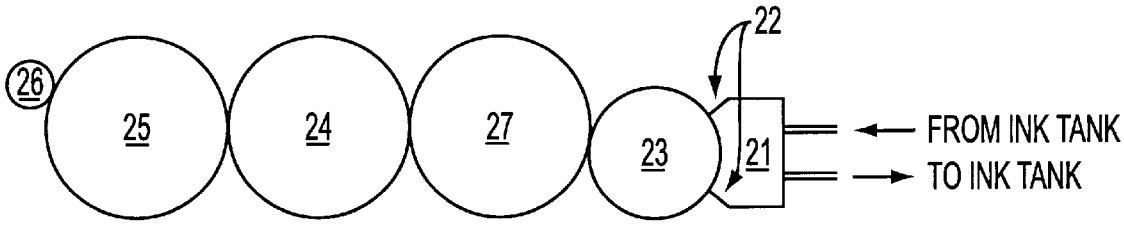
FIG. 3 is a schematic view of a printer used in Example 4.

FIG. 3 is a view showing another example of the disposition of components in a printer for use in the present invention. This printer comprises four rollers including an engraving roller 23, a rubber roller 27, a plate cylinder 24 and a blanket wheel 25, and is designed such that the rollers all are driven in the forward direction. The rubber roller, the plate cylinder and the blanket wheel rotate at the same peripheral speed when a printing plate and a blanket each having a predetermined thickness are fixed to the plate cylinder and the blanket wheel, respectively.

In this mechanism, the engraving roller 23 is driven independently of the rubber roller 27, the plate cylinder 24 and the blanket wheel 25, and the peripheral speed thereof can be freely set.

The ink is fed from a chamber-type ink feeding unit 21 with doctor blades 22, and the doctor blade is disposed to contact the engraving roller.

The bright ink is picked up by the engraving roller 23 from the ink feeding unit 21 and fed to the printing plate via the rubber roller 27. Subsequently, the ink in the image area of the printing plate is transferred to the blanket and further transferred to a thin-wall seamless can mounted on a mandrel 26, to thereby obtain a printed can.

Figure 4:
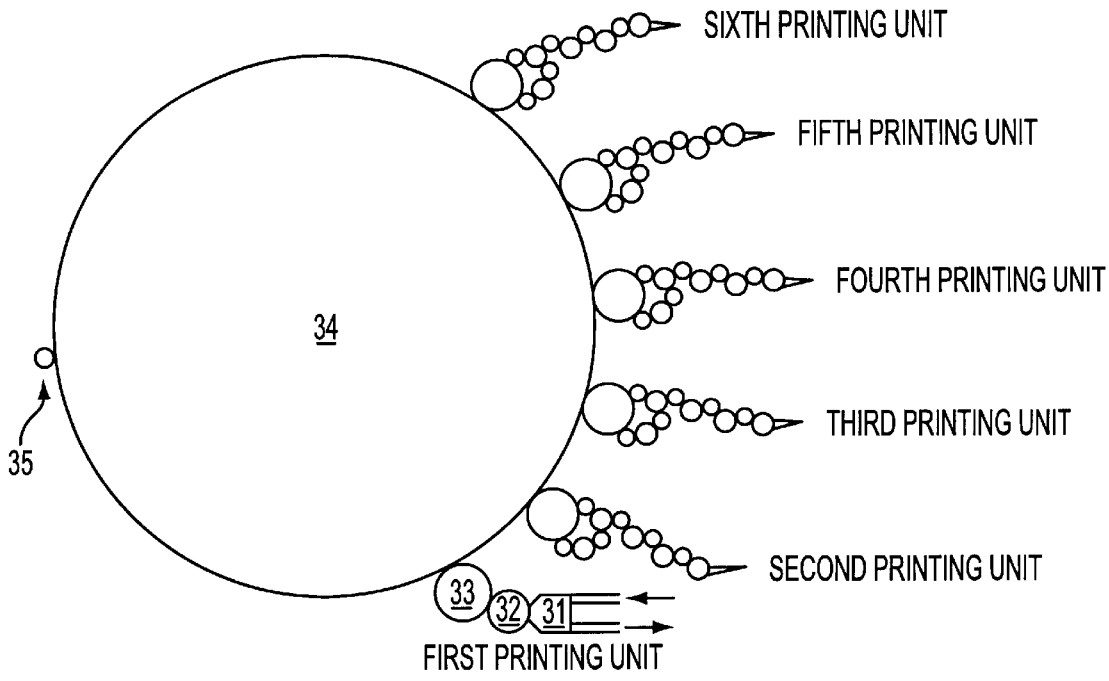
FIG. 4 is a schematic view of a multicolor printer used in Example 6.

FIG. 4 is a view showing one example of the disposition of components when the present invention is applied to a multiple color printer for printing on a can barrel, where the first to sixth printing units are disposed to surround a blanket wheel 34.

The first printing unit comprises an engraving roller 32 and a plate cylinder 33, and performs the printing with a bright ink filled in a chamber-type ink feeding unit 31.

The second to sixth printing units are a known multiple roller-type printing unit and perform the printing with a pasted color ink.

The inks are sequentially transferred to the common blanket from the plate cylinder of each unit such that the respective patterns do not overlap, and the patterns are transferred at one time to a thin-wall seamless can 35 mounted on a mandrel, whereby a multicolor printed image with a bright ink layer can be formed on the surface of the seamless can.

On the engraving roller for use in the present invention, two groups of parallel lines spaced at a constant distance run to intersect each other and micro-holes having a trapezoidal section are formed in a lattice defined by the parallel lines. The parallel lines generally run at a pitch of from 80 to 220 lines/inch, preferably from 100 to 180 lines/inch. The parallel lines in one group preferably make an angle of from 25 to 75°, more preferably from 30 to 60° from the axis, and the parallel lines in another group are provided symmetrically to those parallel lines with respect to the roller axis.

The micro-hole generally has a diameter of from 80 to 300 $\mu$m, and a depth of from 6 to 50 $\mu$m, preferably a diameter of from 100 to 250 $\mu$m and a depth of from 10 to 30 $\mu$m. The micro-hole may have the shape of an inverted truncated cone, inverted truncated pyramid or the like.

In another example of the engraving roller for use in the present invention, two groups of parallel lines spaced at a constant distance run to intersect each other, and fine protrusions having a trapezoidal section are provided in a lattice defined by the parallel lines. In this case, the parallel lines generally run at a pitch of preferably from 120 to 220 lines/inch, preferably from 150 to 200 lines/inch. The parallel lines in one group preferably make an angle of from 25 to 75°, more preferably from 30 to 60° from the axis, and the parallel lines in another group are provided symmetrically to those parallel lines with respect to the roller axis.

The apex of the fine protrusion generally has a diameter of from 70 to 150 μm, preferably from 75 to 120 μm. The height of the protrusion is generally from 10 to 30 μm, preferably from 15 to 25 μm. The fine protrusion may have the shape of a truncated cone, truncated pyramid or the like.

The construction material of the engraving roller is not particularly limited but it is usually made of steel.

For the printing plate, a resin-made relief printing plate which itself is known is used within the range of satisfying the condition that the JISA hardness thereof is 90° or less, preferably from 40 to 90°.

For the rubber roller, a transfer rubber roller which itself is known is used within the range of satisfying the condition that the JISA hardness thereof is 60° or less, preferably from 20 to 50°.

For the blanket, a known blanket conventionally used for printing on a can barrel can be used.

Printing Ink (1) Bright Pigment

The bright pigment for use in the present invention comprises at least one aluminum flake or fine particulate coated pearl pigment and has an average particle size within the above-described range.

Both bright pigment particles are flat, readily orient in parallel to the plane direction at the printing, and have a particular metallic or pearly luster.

As the aluminum flake, a leafing type aluminum flake and a non-leafing type aluminum flake are known. The leafing type aluminum flake is obtained by treating an aluminum flake with a higher fatty acid such as stearic acid and has a tendency to migrate to the surface of the ink layer, but tends to lack a brilliant feeling. On the other hand, the non-leafing type aluminum flake does not tend to migrate to the surface of the ink layer and depending on the viewing angle, provides a strong brilliant feeling. WO 99/04910 (JP-A-11-90318) describes a method of forming a bright coating layer using a bright pigment, which is made from non-leafing type aluminum flakes. In the present invention, either a leafing type or non-leafing type aluminum flake can be used. In addition, a so-called colored aluminum flake in which fine particle or coloring material is attached to the aluminum flake to impart a metallic feeling having a particular tone may also be used.

As the fine particulate coated pearl pigment, known fine particulate coated pearl pigment may be used without particular limitation, but a suitable example thereof is a titanium mica pigment. The generation of interference chromatic color is described taking the titanium mica pigment as an example. The titanium mica pigment comprises a mica substrate having a large aspect ratio and a titanium dioxide fine particle-precipitated layer (hereinafter also referred to as a titanium layer) formed on the surface of the mica substrate.

When rays of light enter this titanium mica pigment, a ray of light entering and reflecting on the surface of the titanium layer and a ray of light entering and reflecting at the interface of the titanium layer and the mica substrate interfere to generate interference light.

A fixed relationship is present between the thickness of the titanium layer and the chromatic color generated by the interference of light, as shown in Table 1 below, where optical distance=(geometrical thickness)×(refractive index of titanium oxide).

TABLE 1

| Color | Optical Distance (nm) | Geometrical Thickness (nm) | $TiO_2$ per 1 $m^2$ (mg) |
|---|---|---|---|
| Silver | 96 | 35 | 85 |
| Light Gold | 150 | 59 | 145 |
| Gold | 175 | 71 | 163 |
| Red | 250 | 95 | 186 |
| Violet | 297 | 117 | 231 |
| Blue | 325 | 129 | 250 |
| green | 358 | 145 | 275 |
| Second order gold | 412 | 161 | 320 |
| Second order violet | 487 | 194 | 385 |

The titanium mica pigment is obtained using a flake-like crystal of mica ($3Al_2O_3.K_2O.6SiO_2.nH_2O$) as a nucleus by depositing titanium oxide hydrate on the nucleus and baking to form titanium dioxide. The titanium dioxide layer on the surface may be either anatase type or rutile type.

The mica is a flake-like crystal characterized by having cleavability and having a thickness of 1 μm or less and an aspect ratio as large as 50 or more. When a thin layer of a titanium pigment having a large diffraction index is formed on the surface thereof, the interference chromatic color shown in Table 1 is obtained.

(2) Printing Ink Composition

The printing ink for use in the present invention is obtained by dispersing the above-described bright pigment in a vehicle and additives, if desired, together with another coloring agent.

Examples of the vehicle which can be used include oil, resin, solvent and plasticizer.

Examples of the oils include drying oil such as linseed oil and boiled linseed oil, semi-drying oil such as soybean oil, and non-drying oil such as castor oil. These are used individually or in combination. These oils are also used for the modification of resin, which is described below.

Examples of the resin include naturally occurring resin such as rosin, modified rosin and gilsonite, and synthetic resin such as phenolic resin, alkyd resin, xylene resin, urea resin, melamine resin, polyamide resin, acrylic resin, epoxy resin, ketone resin, petroleum resin, vinyl chloride resin, vinyl acetate resin, chlorinated polypropylene, chlorinated rubber, cyclized rubber and cellulose derivative. These are used individually or in combination of two or more.

Examples of the solvent which can be used include toluene, methyl ethyl ketone (MEK) and solvent naphtha.

Examples of the plasticizer which can be used include phthalic acid ester-type, adipic acid ester-type, citric acid ester-type and polyester-type plasticizers.

Examples of the additive which can be used include naturally occurring or synthetic waxes, desiccating agent, dispersant, wetting agent, cross-linking agent, gelling agent, thickener, anti-skinning agent, stabilizer, delustering agent, defoaming agent and photopolymerization initiator.

As the coloring agent, a dye or pigment which itself is known can be used. Suitable examples thereof include the following.

Black Dye and Pigment

Carbon black, acetylene black, lamp black, aniline black and nigrosine black.

Yellow Dye and Pigment

Zinc yellow, cadmium yellow, yellow iron oxide, mineral fast yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake.

Orange Dye and Pigment

Red chrome yellow, molybdenum orange, Permanent Orange GTR, pyrazolone orange, Vulcan Orange, Indanthrene Brilliant Orange RK, Benzidine Orange 6 and Indanthrene Brilliant Orange GK.

Red Dye and Pigment

Red iron oxide, cadmium red, red lead, mercury cadmium sulfide, Permanent Red 4R, lithol red, pyrazolone red, Watchung Red Calcium Salt, Lake Red D, Brilliant Carmine 6B, eosine lake, Rhodamine Lake B, alizarin lake and Brilliant Carmine 3B.

Violet Dye and Pigment

Manganese violet, Fast Violet B and Methyl Violet Lake.

Blue Dye and Pigment

Prussian blue, cobalt blue, Alkali Blue Lake, Victoria Blue Lake, Phthalocyanine Blue, nonmetallic Phthalocyanine Blue, Phthalocyanine Blue partial chlorinated product, Fast Sky Blue and Indanthrene Blue BC.

Green Dye and Pigment

Chrome green, chromium oxide, Pigment Green B, Malachite Green Lake and Final Yellow Green G.

White Dye and Pigment

Zinc white, titanium oxide, antimony white and zinc sulfide.

Extender Pigment

Barite powder, barium carbonate, clay, silica, white carbon, talc and alumina white.

These pigments are preferably used as a flushed pigment in view of dispersibility. See, for example, K. Igarashi and N. Noguchi, "Pigment Dispersion in Printing Inks", Dainippon Ink and Chemicals, Inc. (1997).

The ink vehicle may be either heat-curable or uv-curable.

In the case of a heat-curable vehicle, inks using an alkyd-base or polyester-base vehicle are preferred.

The alkyd-base or polyester-base vehicle is a resin obtained by condensation-polymerizing (i) at least one polyhydric alcohol such as glycerin, pentaerythritol, ethylene glycol, diethylene glycol, triethylene glycol, propylene glycol, sorbitol, mannitol and trimethylolpropane with (ii) at least one polybasic acid such as phthalic acid anhydride, isophthalic acid, maleic acid, fumaric acid, sebacic acid, adipic acid, citric acid, tartaric acid, malic acid, diphenic acid, 1,8-naphthalic acid, terpene oil and rosin, and if desired, modifying it with (iii) a fatty oil or fatty acid such as linseed oil, soybean oil, perilla oil, fish oil, tung oil, sunflower oil, walnut oil, oiticica oil, castor oil, dehydrated castor oil, sperm fatty acid, cotton seed oil and coconut oil, or a monoglyceride of the fatty acid. This resin can also be used in the form of rosin modification, non-drying fatty acid modification, urea melamine resin modification, drying oil fatty acid modification, carbolic acid resin modification, maleic acid resin modification, ester rosin modification or other natural resin modification.

Examples of the hardening agent which can be used include metal soaps and naphthenates of various metals such as lead, cobalt, zinc and manganese.

Examples of the uv-curable ink vehicle include a combination of uv-curable epoxy resin and a cationic photopolymerization catalyst.

The uv-curable epoxy resin is a resin containing an epoxy resin component where the molecule has an alicyclic group and a carbon atom adjacent to the alicyclic group has an oxylane ring. For example, epoxy compounds having at least one epoxycycloalkane group within the molecule, such as epoxycyclohexane ring or epoxycyclopentane ring, can be used individually or in combination.

Suitable examples thereof include, though the present invention is not limited thereto, vinylcyclohexene diepoxide, vinylcyclohexene monoepoxide, 3,4-epoxycyclohexylmethyl-3,4-epoxycyclohexane carboxylate, 2-(3,4-epoxycyclohexyl-5,5-spiro-3,4-epxoy) cyclohexane-m-dioxane, bis(3,4-epoxycyclohexyl) adipate and limonene dioxide.

The cationic ultraviolet polymerization initiator for use in combination with the epoxy resin decomposes by action of an ultraviolet ray to release a Lewis acid which then polymerizes the epoxy group. Examples thereof include aromatic iodonium salts, aromatic sulfonium salts, aromatic selenium salts and aromatic diazonium salts.

In the printing ink for use in the present invention, the bright pigment content varies depending on the degree of bright feeling required, however, in general, the content is preferably from 5 to 25 wt % based on the solid contents in the ink.

Can Barrel

The printing method of the present invention can be applied to known metal cans without particular limitation, such as a two-piece can and a three-piece can.

Of these metal cans, the two-piece can (seamless can) is produced by draw-deep drawing formation, draw-ironing formation and the like, and after formation thereof, outer surface printing is usually applied to the can body. The present invention is useful for such outer surface printing on a can body.

Therefore, the present invention is described using the two-piece can as an example, however, the present invention is by no means limited thereto.

The two-piece can for use in the printing method according to the present invention is produced by draw-redrawing or draw-ironing a metal blank or organic coated metal blank. An organic coated metal plate may be formed into a cup or a metal cup may afterwards be provided with an organic coating. In view of ease and simplicity of production, an organic coated metal plate formed into a cup is suitably used.

Figure 5:
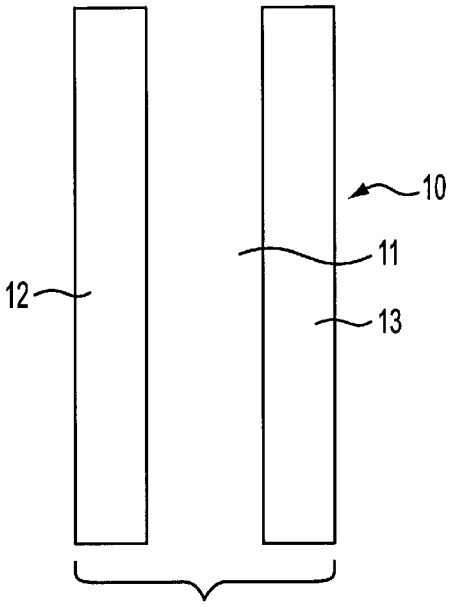
FIG. 5 is a cross-sectional view showing one example of the cross-sectional structure of a two-piece can for use in the printing method of the present invention.

FIG. 5 is a view showing one example of the cross-sectional structure of the two-piece can. The cup 10 comprises a metal substrate 11, an inner organic coating 12 provided on the inner surface side of the substrate, and an outer organic coating 13 provided on the other surface of the substrate.

Figure 6:
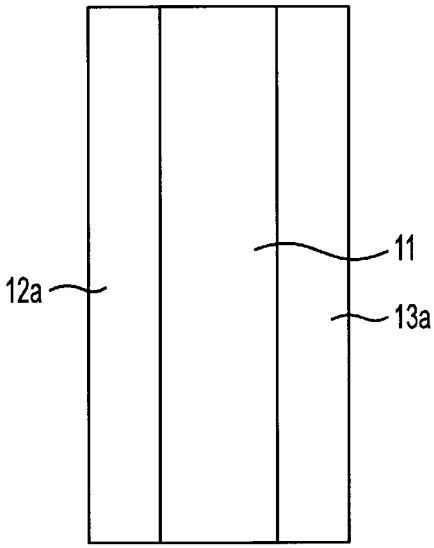
FIG. 6 is a cross-sectional view showing another example of the cross-sectional structure of a two-piece can for use in the printing method of the present invention.

FIG. 6 is a view showing another example of the cross-sectional structure. In this example, an inner organic coating 12*a* is afterwards applied by coating onto a metal substrate 11 formed into a cup. Although a particular organic coating is not formed on the outer surface of the metal substrate 11, coating material 13*a* such as white coat and printing are later applied to the outer surface.

In the present invention, a steel plate subjected to various surface treatments or a light metal plate such as aluminum is used as the metal plate.

The surface-treated steel plate may be obtained by annealing a cold-rolled steel plate and then subjecting it to secondary cold rolling and to one or more surface treatments such as zinc plating, tin plating, nickel plating, electrolytic chromic acid treatment and chromic acid treatment. One suitable example of the surface-treated steel plate is a steel plate subjected to an electrolytic chromic acid treatment. In particular, those plates having a metal chromium layer of from 10 to 200 $mg/m^2$ and a chromium oxide layer of from 1 to 50 $mg/m^2$ (in terms of chromium metal) are preferred because of their excellent combination of coating adhesion and corrosion resistance.

Another example of the surface-treated steel plate is a hard tin plate having a tin plated amount of from 0.5 to 11.2 $g/m^2$. This tin plate is preferably subjected to treatment with chromic acid and/or treatment with chromic acid/phosphoric acid to provide a chromium amount of from 1 to 30 mg/m$^2$ in terms of chromium metal. Yet another example is an aluminum-coated steel plate produced by aluminum plating or aluminum press bonding.

The light metal plate which can be used includes, in addition to an aluminum plate, an aluminum alloy plate. The aluminum alloy plate has excellent corrosion resistance and workability and has a composition such that Mn is from 0.2 to 1.5 wt %, Mg is from 0.8 to 5 wt %, Zn is from 0.25 to 0.3 wt %, Cu is from 0.15 to 0.25 wt % and the balance is Al. These light metals are also subjected to treatment with chromic acid and/or a treatment with chromic acid/phosphoric acid to provide a chromium amount of from 20 to 300 mg/m$^2$ in terms of chromium metal.

The thickness of the metal blank, namely, the thickness (tB) of the can bottom varies depending on the kind of metal or the use or size of the container, however, the metal blank in general preferably has a thickness of from 0.10 to 0.5 mm. Particularly, in the case of a surface-treated steel plate, the thickness is preferably from 0.10 to 0.3 mm, and in the case of a light metal plate, the thickness is preferably from 0.15 to 0.40 mm.

The organic coating provided, if desired, on the metal substrate may be a thermoplastic resin, a thermosetting resin or a composition thereof, however, in general, a thermoplastic resin is preferred. In the case where the metal substrate is an aluminum-base substrate, the resin coating on the outer surface may be omitted.

The thermoplastic resin coated on the metal plate is preferably a crystalline thermoplastic resin, and examples thereof include olefin-base resin film such as polyethylene, polypropylene, ethylene-propylene copolymer, ethylene-vinyl acetate copolymer, ethylene-acryl ester copolymer and ionomer; polyester such as polyethylene terephthalate, polybutylene terephthalate and ethylene terephthalate/isophthalate copolymer; polyamide such as nylon 6, nylon 6,6, nylon 11 and nylon 12; polyvinyl chloride; and polyvinylidene chloride.

The thermoplastic resin coated layer may contain an inorganic filler (pigment) so as to assist transmission of the wrinkling inhibiting force to the metal plate at the draw-redrawing formation or the like. Furthermore, in this film, known compounding ingredients for films may also be blended therein according to a known formulation, and examples thereof include anti-blocking agents such as amorphous silica, antistatic agents of various types, lubricants, antioxidants, and ultraviolet absorbents.

Examples of the inorganic filler include inorganic white pigments such as rutile or anatase titanium dioxide, zinc white and gloss white; white extender pigments such as barite, precipitating barite sulfate, calcium carbonate, gypsum, precipitating silica, aerosil, talc, calcined or non-calcined clay, barium carbonate, aluminum white, synthetic or naturally occurring mica, synthetic calcium silicate and magnesium carbonate; black pigments such as carbon black and magnetite; red pigments such as red iron oxide; yellow pigments such as sienna; and blue pigments such as ultramarine and cobalt blue. The inorganic film may be blended in an amount of from 10 to 500 wt %, preferably from 10 to 300 wt %, of the resin.

The coated thermoplastic resin is coated on the metal plate by heat fusion, dry lamination or extrusion coating. In the case when the adhesive property (heat fusion property) between the coated resin and the metal plate is poor, for example, a urethane-base adhesive, an epoxy-base adhesive, an acid-modified olefin resin-base adhesive, a copolyamide-base adhesive or a copolyester-base adhesive may be interposed therebetween.

The thermoplastic resin generally has a thickness of from 3 to 50 $\mu$m, preferably from 5 to 40 $\mu$m. In the case of heat fusion using a film, the film may be either unstretched or stretched.

The film is suitably produced by forming a polyester mainly comprising an ethylene terephthalate unit or a butylene terephthalate unit into a film according to a T-die method or inflation film forming method, biaxially stretching the film sequentially or simultaneously at a stretching temperature, and then heat-setting the stretched film.

With respect to the starting material polyester, polyethylene terephthalate itself may be used under limited stretching, heat-setting and laminating conditions. However, since the maximum crystallinity which the film can reach is preferably reduced in view of shock resistance or workability, a copolymerization ester unit other than ethylene terephthalate is preferably introduced into the polyester. A biaxially stretched film of copolymerized polyester which mainly comprises an ethylene terephthalate unit or butylene terephthalate unit, contains a slight amount of another ester unit and has a melting point of from 210 to 252° C., is preferably used. In this regard, a homopolyethylene terephthalate generally has a melting point of from 255 to 265° C.

In the copolymerized polyester, a terephthalic acid component generally constitutes 70 mol % or more, preferably 75 mol % or more of the dibasic acid component; ethylene glycol or butylene glycol generally constitutes 70 mol % or more, preferably 75 mol % or more of the diol component; and a dibasic acid component other than terephthalic acid generally constitutes from 1 to 30 mol %, preferably from 5 to 25 mol % of the dibasic acid component.

Examples of the dibasic acid other than terephthalic acid include aromatic dicarboxylic acids such as isophthalic acid, phthalic acid and naphthalene dicarboxylic acid; alicyclic dicarboxylic acids such as cyclohexane dicarboxylic acid; aliphatic dicarboxylic acids such as succinic acid, adipic acid, sebacic acid and dodecanedionic acid. These may be used individually or in combination of two or more thereof. Examples of the diol component other than ethylene glycol and butylene glycol include propylene glycol, diethylene glycol, 1,6-hexylene glycol, cyclohexane dimethanol and ethylene oxide adduct of bisphenol A. These may be used individually or in combination of two or more thereof. Furthermore, the combination of these comonomers must satisfy the above-described melting point range of the copolymerized polyester.

The polyester thus used has a molecular weight high enough to form a film. Therefore, the intrinsic viscosity (I.V.) of the polyester is preferably 0.55 to 1.9 dl/g, more preferably from 0.65 to 1.4 dl/g.

The film is generally stretched at a temperature of from 80 to 110° C. and an area stretching magnification of from 2.5 to 16.0, preferably from 4.0 to 14.0. The heat setting of the film is preferably performed at a temperature of from 130 to 240° C., more preferably from 150 to 230° C.

The polyester film is preferably biaxially stretched and the degree of biaxial orientation can be confirmed by the density determined according to a polarization fluorescent method, birefringence method, density gradation tube method or the like.

In laminating a layer, the laminated film is allowed to pass through the crystallization temperature region within a short a time as possible, preferably within 10 seconds, more preferably 5 seconds, so as to prevent excess crystallization. Accordingly, the lamination is performed such that only the metal blank is heated and immediately after laminating the film, the laminate is forcedly cooled. For the cooling, direct contact with a cold gas stream or cold water or press contact by a forcedly cooled cooling roller is used. At this lamination, it should be understood that when the film is heated to a temperature in the vicinity of the melting point and after the lamination, rapidly cooled, the degree of crystal orientation can be mitigated.

In the case of using a primer for the adhesion, the film surface is preferably subjected to corona discharge treatment so as to enhance the adhesive property between the film and the primer for the adhesion. The corona discharge treatment is preferably performed to such a degree as to have a wet tension of 44 dyne/cm or more.

Other than this, the film may be subjected to a known surface treatment for improving the adhesive property, such as plasma treatment or flame treatment, or to a coating treatment with urethane resin or modified polyester resin for improving the adhesive property.

The adhesive primer provided, if desired, between the polyester film and the metal blank exhibits excellent adhesive property to both the metal blank and the film. A representative example of the primer coating material having excellent adhesion and high corrosion resistance is a phenol epoxy-base coating material comprising a resol-type phenol aldehyde resin derived from various phenols and formaldehyde, and a bisphenol-type epoxy resin, particularly a painting material containing the phenolic resin and the epoxy resin at a weight ratio of from 50:50 to 5:95, preferably from 40:60 to 10:90.

The adhesive primer layer preferably has a thickness of from 0.3 to 5 $\mu$m. The adhesive primer layer may be previously provided on the metal blank or on the polyester film.

The polyester layer as a coating of the metal may be provided by extrusion coating in place of applying it in the form of a biaxially stretched film. The extrusion coating is performed such that a web of melted resin extruded from a die is fed onto a heated metal substrate and press bonded by a laminate roller and immediately, the laminate is rapidly cooled.

Examples of the resin coating material for use in the coating include phenol-formaldehyde resin, furan-formaldehyde resin, xylene-formaldehyde resin, ketone-formaldehyde resin, urea formaldehyde resin, melamine-formaldehyde resin, alkyd resin, unsaturated polyester resin, epoxy resin, bismaleimide resin, triallylcyanurate resin, thermosetting acrylic resin, silicone resin, oily resin and a composition comprising this thermosetting resin and a thermoplastic resin coating material such as vinyl chloride-vinyl acetate copolymer, vinyl chloride-maleic acid copolymer, vinyl chloride-maleic acid-vinyl acetate copolymer, acrylic polymer or saturated polyester resin. These resin coating materials can be used individually or in combination of two or more thereof.

The formation of the two-piece can (seamless can) may be performed by known means such as draw-redrawing, draw-redraw-ironing, draw-bend elongation redrawing and draw-bend elongation-ironing.

For example, according to the deep drawing formation (draw-redrawing) technique, a pre-drawn cup formed from a coated metal plate is held by an annular holding member inserted into the cup and a redrawing die is positioned thereunder. Coaxially with the holding member and redrawing die and at the same time, removably from the holding member, a redrawing punch is disposed. The redrawing punch and the redrawing die are moved relative to one another such that the punch and die engage.

By setting as such, the side wall part of the pre-drawn cup is vertically bent inward in the diameter direction upon passing from the outer peripheral surface of the annular holding member through the curvature corner part thereof, bent nearly vertically in the axial direction at the working corner part of the redrawing die upon passing through the part defined by the annular bottom surface of the annular holding member and the top surface of the redrawing die, and thereby formed into a deep-drawn cup having a diameter smaller than that of the pre-drawn cup.

Furthermore, by setting the radius of curvature (Rd) of the working corner part of the redrawing die to from 1 to 2.9 times, preferably from 1.5 to 2.9 times, the thickness of the metal blank (tB), the side wall part can be effectively reduced upon bend elongation. Moreover, fluctuation of the thickness at the bottom and the top of the side wall part can be eliminated and uniform reduction in the wall thickness can be obtained throughout the side wall. In general, the side wall part of a can barrel can be reduced in thickness at a thickness reduction ratio (variation coefficient of thickness) of from 5 to 45% (from −5 to −45%), preferably from 5 to 40% (from −5 to −40%), based on the thickness of the blank.

In the case of a deep-drawn can, the drawing ratio RD defined by the following formula (2):

$$RD = \frac{D}{d} \tag{2}$$

(wherein D is the diameter of the sheared laminate material and d is the diameter of the punch) is preferably from 1.1 to 3.0 in the first stage, and from 1.5 to 5.0 in total.

Also, by disposing a die in the rear side of the redrawing or bend elongation redrawing, the thickness can be reduced upon ironing to have a thickness such that the ironing ratio RI defined by the following formula (3):

$$RI = \frac{tB - tW}{tB} \times 100 \tag{3}$$

(wherein tB is the blank thickness and tW is the thickness of the side wall part) is from 5 to 70%, preferably from 10 to 60%.

The drawing formation and the like preferably includes coating various lubricants such as liquid paraffin, synthetic paraffin, edible oil, hydrogenated edible oil, palm oil, various naturally occurring wax and polyethylene wax. The coated amount of the lubricant varies depending on the kind of lubricant but it is generally from 0.1 to 10 mg/dm$^2$, preferably from 0.2 to 5 mg/dm$^2$. The lubricant is coated by spraying in a melted state onto the surface.

In order to improve the draw-formability into a cup, the formation is preferably performed by previously setting the temperature of the resin coated drawn cup at a temperature higher than the glass transition point (Tg) of the coated resin, particularly lower than the heat crystallization temperature, and thereby facilitating the plastic flow of the resin coated layer.

After the formation, the inner side organic coated metal-made cup is subjected to a so-called trimming treatment of cutting the lug at the cup opening part and then used for printing. In advance of this trimming treatment, the formed cup may be heated at a temperature of from the glass transition point (Tg) of the coated resin to the melting point so as to mitigate the distortion of the coated resin. This operation is effective particularly in the case of a thermoplastic resin for increasing the adhesion between the coating and the metal.

According to the present invention, printing is provided on the barrel of a can produced as above using a printer shown in FIGS. 2 to 4.

In printing on a can barrel, a clear coating is generally formed on the ink layer. The clear coating is similarly formed using an applicator roller having applied thereto a clear coating material by contacting this applicator roller with the outer surface of the printed can body.

The printing ink layer and the clear coating may be formed by a wet-on-wet technique or after the curing of the printing ink layer, the clear coating may be formed by a wet-on-dry technique.

For the clear coating applied on the printing ink layer, a material called finishing varnish in the field of can manufacturing is generally used. For this clear coating, a resin having excellent transparency of the resins described above with respect to the printing ink is used without adding a bright pigment or coloring agent. This resin may be either heat-curable or uv-curable.

The thickness of the clear coating is not particularly limited as long as it can satisfactorily protect the printing ink layer, however, in general, it is preferably from 3 to 10 $\mu$m, more preferably from 4 to 6 $\mu$m.

The printing ink layer and the clear coating each can be cured, in the case of heat curing, at a temperature of from 180 to 220° C. In the case of ultraviolet curing, the ultraviolet ray used, including the near ultraviolet region, generally has a wavelength of from 200 to 430 nm, preferably from 240 to 420 nm. Examples of the ultraviolet light source which can be used include halide lamp, high-pressure mercury lamp and low-pressure mercury lamp. The thickness of the coating layer is small, therefore, the energy necessary for the curing can be advantageously reduced to a considerable extent and in general, an energy of from 500 to 5,000 joule/m$^2$ may suffice.

The present invention is described in greater detail below by referring to the Examples, however, the present invention should not be construed as being limited thereto.

Preparation of Thin-Wall Seamless Can

A 20 $\mu$m-thick biaxially stretched polyethylene terephthalate/isophthalate copolymer film was heat bonded to a side (forming the interior surface of a can) of a tin-free steel plate having a blank thickness of 0.18 mm and a refining degree of DR-9 (surface treated to have a chromium coated amount of 120 mg/m$^2$ and a chromium oxide coated amount of 15 mg/m$^2$), and a 15 $\mu$m-thick biaxially polyethylene terephthalate/isophthalate copolymer film containing 20 wt % of titanium oxide was heat bonded to the side forming the outer surface of the can. This heat bonding on both surfaces was performed simultaneously at the melting point of the film and then the films were immediately cooled with water, thereby obtaining an organic coated metal plate. After uniformly coating a glamour wax on the thus-obtained organic coated metal plate, the metal plate was punched into a disk having a diameter of 160 mm and then formed into a shallow-drawn cup by an ordinary method. At this drawing step, the drawing ratio was 1.59.

The cup was subsequently subjected to primary and secondary redrawing processes to obtain a thin-wall deep-drawn cup. The formation conditions in the redrawing processes and various properties of the redraw-formed deep-drawn cup are shown below.

Primary redrawing ratio: 1.23

Secondary redrawing ratio: 1.24

Radius of curvature at the working corner part of redrawing die: 0.30 mm

Radius of curvature at the holding corner of redrawing die: 1.0 mm

Diameter of cup: 66 mm

Height of cup: 130 mm

Rate of change in the thickness of side wall: −40%

Thereafter, the deep-drawn cup prepared above was domed in a usual manner and then heat treated at 215° C. for 1 minute to remove the processing distortion of the film and also volatilize the lubricant. Subsequently, the edge part of the opening was trimmed to obtain a resin coated thin-wall seamless can having a height of 123 mm.

Ink

Aluminum flake or fine particulate coated pearl was dispersed in a vehicle in an amount shown in Table 2 to prepare a bright ink.

Measurement of Viscosity

Using a cone/plate type rotary viscometer ARES—(manufactured by Rheometrix Scientific FE K.K.), the apparent viscosity of the ink was measured at 35° C. and a shear rate of 100 sec$^{-1}$. The results are shown in Table 2.

Measurement of Particle Size of Pigment in Bright Ink

A slight amount of unused ink was dropped onto a slide glass and spread with a cover glass. Thereafter, the slide glass was placed in an oven to cure the ink. This sample was observed through a reflection-type microscope, an enlarged photograph of the bright ink part was taken, and the average particle size of the bright pigment was calculated from the photograph. On the other hand, with respect to the ink printed on a can, the ink was cured in an oven, the can was cut open into a plate form, an enlarged photograph of the bright printed portion was taken by a reflection-type microscope, and the average particle size of the bright pigment was calculated from the photograph.

Measurement of Hardness of Printing Plate

A printing plate was placed on a flat desk and the hardness of the image area was measured using a JISA hardness meter.

EXAMPLE 1

FIG. 2 is a schematic view of a printer. This printer comprises three rollers including an engraving roller 23, a plate cylinder 24 and a blanket wheel 25. All the rollers are driven in the forward direction and rotate at the same peripheral speed when a printing plate and a blanket each having a predetermined thickness are fixed to the plate cylinder and the blanket wheel, respectively. The ink is fed from a chamber-type ink feeding unit 21 with doctor blades 22, and the doctor blade is disposed to contact the engraving roller.

The engraving roller was designed such that two groups of parallel lines running at a pitch of 120 lines/inch while making an angle of 45° or 135° from the roller axis intersect at a right angle with each other, and holes in the form of an inverted truncated pyramid having a depth of 20 $\mu$m were provided in a lattice defined by the parallel line groups. One side of the square hole opening was 170 $\mu$m and one side of the square hole bottom was 110 $\mu$m. After the excess ink was scraped off by the doctor blade, the ink fed to the engraving roller from the chamber-type ink feeding unit was held in the hole parts.

The printing plate used was a resin relief printing plate and the blanket used was a known blanket for two-piece cans, both having a JISA hardness of 70°. The pressure between the engraving roller and the printing plate and the pressure between the printing plate and the blanket were set to provide a nearly kiss touch state to the extent possible within the range of not generating pressure unevenness or pressure relief. The pressure between the blanket and a can was applied in a usual manner.

Bright Ink A was picked up by the engraving roller 23 from the ink feeding unit 21 and fed to the printing plate. Subsequently, the ink on the image area of the printing plate was transferred to the blanket and further transferred to a thin-wall seamless can mounted on a mandrel 26, to thereby obtain a printed can. The engraving roller, the plate cylinder and the blanket wheel were driven at a peripheral speed of 50 m/min. In order to make an evaluation after the receipt and feed balance of ink among rollers reached a satisfactorily steady state, the 20th and subsequent printed cans from the start of printing were selected as samples. The printed cans exhibited an excellent bright feeling and good image reproducibility. Thereafter, these printed cans were heated in a hot blast circulating-type oven to cure the wet ink film and the particle size of the bright pigment in the ink layer was observed using a reflection-type microscope. As a result, no significant difference was observed in particle size between the bright pigment in the ink layer and the bright pigment in the unused ink.

EXAMPLE 2

Printed cans were manufactured in the same manner as in Example 1 except for using Bright Ink B. The printed cans exhibited excellent brightness and no significant difference was observed in particle size between the bright pigment in the ink layer and the bright pigment in the unused ink. The image reproducibility was also good.

EXAMPLE 3

FIG. 3 is a schematic view of a printer. This printer comprises four rollers including an engraving roller 23, a rubber roller 27, a plate cylinder 24 and a blanket wheel 25, and is designed such that the rollers are all driven in the forward direction. The rubber roller, the plate cylinder and the blanket wheel rotate at the same peripheral speed when a printing plate and a blanket each having a predetermined thickness are fixed to the plate cylinder and the blanket wheel, respectively. In this mechanism, the engraving roller 23 is driven independently of the rubber roller 27, the plate cylinder 24 and the blanket wheel 25, and the peripheral speed thereof can be freely set. Furthermore, the ink is fed from a chamber-type ink feeding unit 21 with doctor blades 22, and the doctor blade is disposed to contact the engraving roller.

The engraving roller used was designed such that two groups of parallel lines running at a pitch of 120 lines/inch while making an angle of 45° or 135° from the roller axis intersect at a right angle with each other. Also, holes in the form of a truncated pyramid having a depth of 25 $\mu$m were provided in a lattice defined by the parallel line groups. One side of the square truncated pyramid bottom was 130 $\mu$m and one side of the square truncated pyramid apex was 58 $\mu$m. After the excess ink was scraped off by the doctor blade, the ink fed to the engraving roller from the chamber-type ink feeding unit was held in the trough parts between one protrusion and another protrusion.

The rubber roller used had a JISA hardness of 30°. The printing plate used was a resin relief printing plate and the blanket used was a known blanket for two-piece cans, both having a JISA hardness of 80°. The printing plate used had an image area of 200 $cm^2$. The pressure between the engraving roller and the rubber roller, the pressure between the rubber roller and the printing plate and the pressure between the printing plate and the blanket were set to provide a nearly kiss touch state to the extent possible within the range of not generating pressure unevenness or pressure relief. The pressure between the blanket and a can was applied in a usual manner.

Bright Ink C was picked up by the engraving roller 23 from the ink feeding unit 21 and fed to the printing plate via the rubber roller 27. At this time, the engraving roller, the rubber roller, the plate cylinder and the blanket wheel all were driven at the same peripheral speed of 50 m/min. Subsequently, the ink on the image area of the printing plate was transferred to the blanket and further transferred to a thin-wall seamless can mounted on a mandrel 26, to thereby obtain a printed can. In order to make an evaluation after the receipt and feed balance of ink among rollers reached a satisfactorily steady state, the 20th and subsequent printed cans from the start of printing were selected as samples. The printed cans exhibited an excellent bright feeling and good image reproducibility. The weight of the ink transferred to the can was measured and found to be 62 mg. Thereafter, these printed cans were heated in a hot blast circulating-type oven to cure the wet ink film, and the particle size of the bright pigment in the ink layer was observed using a reflection-type microscope. As a result, no significant difference was observed in particle size between the bright pigment in the ink layer and the bright pigment in the unused ink.

EXAMPLE 4

Printed cans were manufactured in the same manner as in Example 3, except for changing the peripheral speed Va of the engraving roller to 55 m/min. The weight of the ink transferred to the can was 35 mg, thus, the transferred amount of ink was reduced as compared with the case of Example 3. The printed cans exhibited sufficiently high brightness considering the thickness of the ink film. The image reproducibility was also good. The thus-manufactured printed cans were heated in a hot blast circulating-type oven to cure the wet ink film, and the particle size of the bright pigment in the ink layer was observed using a reflection-type microscope. As a result, no significant difference was observed in particle size between the bright pigment in the ink layer and the bright pigment in the unused ink. From these results, it was verified that when the peripheral speed of the engraving roller is increased higher than the peripheral speed of the rubber roller, only the transferred amount of ink is reduced without causing any adverse effect on the grain size distribution of the bright pigment. Therefore, for example, when the thickness of the ink film excessively increases during the printing, by driving the engraving roller at a higher speed than the rubber roller, the thickness of the ink film can be controlled. Moreover, printed matter from ink films of different thicknesses can be obtained without exchanging the engraving roller.

EXAMPLE 5

Printed cans were manufactured in the same manner as in Example 3, except for changing the peripheral speed Va of the engraving roller to 40 m/min. The amount of ink transferred to a can was 56 mg, such that the transferred amount of ink was reduced as compared with Example 3. The printed cans exhibited sufficiently high brightness considering the thickness of the ink film. The image reproducibility was also good. The thus-manufactured printed cans were heated in a hot blast circulating-type oven to cure the wet ink film, and the particle size of the bright pigment in the ink layer was observed using a reflection-type microscope. As a result, no significant difference was observed in particle size between the bright pigment in the ink layer and the bright pigment in the unused ink. From these results, it was verified that when the peripheral speed of the engraving roller is decreased lower than the peripheral speed of the rubber roller, the transferred amount of ink is reduced without causing any adverse effect on the grain size distribution of the bright pigment. Therefore, for example, when the thickness of the ink film excessively increases during the printing, by driving the engraving roller at a lower speed than the rubber roller, the thickness of the ink film can be controlled and moreover, printed matter formed from ink films of different thicknesses can be obtained without exchanging the engraving roller.

EXAMPLE 6

FIG. 4 is a schematic view of a multicolor printer. The first to sixth printing units are disposed to surround a blanket wheel 34. The first printing unit comprises an engraving roller 32 and a plate cylinder 33 which are driven at the same peripheral speed, and performs the printing with a bright ink filled in a chamber-type ink feeding unit 31. The second to sixth printing units are a known multiple roller-type printing unit, and each performs the printing with a pasted color ink. The inks are sequentially transferred to the common blanket from the plate cylinder of each unit such that respective patterns do not overlap, and the patterns are transferred at the same time to a thin-wall seamless can mounted on a mandrel.

The printing plate used for the first printing unit was a resin relief printing plate having a JISA hardness of 70°, and the plate cylinder used for other printing units was a known resin relief printing plate for two-piece cans. The engraving roller was the same as used in Example 1, the blanket used was a known blanket for a two-piece can, and the bright ink was the same as used in Example 1. By driving a printer at a peripheral speed of 500 m/min, the printing was performed. In order to make an evaluation after the receipt and feed balance of ink among rollers reached a satisfactorily steady state, the 20th and subsequent printed cans from the start of printing were selected as samples. The printed cans had a multicolor printed matter favored with excellent bright feeling, superior design effect with sharp colors, and good image reproducibility. The thus-manufactured printed cans were heated in a hot blast circulating-type oven to cure the wet ink film, and the particle size of the bright pigment in the ink was observed using a reflection-type microscope. As a result, no significant difference was observed in particle size between the bright pigment in the ink layer and the bright pigment in the unused ink.

Comparative Example 1

Printed cans were manufactured in the same manner as in Example 1, except for using Bright Ink D. Bright Ink D had a viscosity as high as 50 poise at 100 $sec^{-1}$ and the ink tended to accumulate on the printing plate, therefore, the image was greatly blotted or thickened. However, the bright feeling was good. The particle size. of the bright pigment in the cured ink layer was observed, but no significant difference from the particle size of the bright pigment in unused ink was found.

Comparative Example 2

Printed cans were manufactured in the same manner as in Example 1, except for using a printing plate having a JISA hardness of 99°. Due to the use of an excessively hard printing plate, the bright pigment accumulated on the printing plate and the bright feeling of the printed can were poor. Also, the image reproducibility was reduced.

The particle size of the bright pigment in the cured ink layer was observed. As a result, the ratio of a pigment having a large particle size in the ink layer was extremely decreased as compared with the unused ink.

Comparative Example 3

Printed cans were manufactured in the same manner as in Example 3, except for using a rubber roller having a JISA hardness of 80°. Due to the use of an excessively hard rubber roller, the ink failed in transferring from the rubber roller to the printing plate and the printed image was thin and uneven. Therefore, the printed cans could not achieve the level required of a printed matter.

Comparative Example 4

Printed cans were manufactured in the same manner as in Example 3, except for changing the peripheral speed Va of the engraving roller to 110 m/min. The ratio Vr/Va of the peripheral speed Vr of the rubber roller to Va was 0.45 which is outside the scope of a preferred embodiment of the present invention. Due to this, the ink transferability was greatly decreased and the bright pigment was poorly transferred. Therefore, the printed cans could not achieve the level required of a printed matter.

Comparative Example 5

Printed cans were manufactured in the same manner as in Example 3, except for changing the peripheral speed Va of the engraving roller to 20 m/min. The ratio Vr/Va of the peripheral speed Vr of the rubber roller to Va was 2.5 which is outside the scope of a preferred embodiment of the present invention. Due to this, the ink transferability was greatly decreased and the bright pigment was poorly transferred. Therefore, the printed cans could not achieve the level required of a printed matter.

The results of the Examples and Comparative Examples are shown together in Table 3.

TABLE 2

Blending and Viscosity of Bright Ink

| | Weight-Mix Part | | | | | | | |
|---|---|---|---|---|---|---|---|---|
| | Bright Pigment | | | | | | | |
| Ink | Non-Leafing Type Scale-Like Aluminum Flake, Average Particle Size: 11 μm Note 1 | Leafing Type Scale-Like Aluminum Flake, Average Particle Size: 8 μm Note 2 | Titanium Oxide-Coated Mica, Average Particle Size: 16 μm Note 3 | Yellow Pigment | Red Pigment | Vehicle A | Vehicle B | Apparent Viscosity at 35° C. and 100 $sec^{-1}$, poise |
| Bright Ink A | 12 | None | None | 6 | 2 | 80 | None | 10 |
| Bright Ink B | 8 | None | None | 4 | 1 | 79 | None | 8 |
| Bright Ink C | None | 15 | None | None | None | 85 | None | 6 |
| Bright Ink D | 12 | None | None | 6 | 2 | None | 80 | 50 |

Note 1: product of TOYO ALUMINUM CO. LTD. "TCR 2150"
Note 2: product of TOYO ALUMINUM CO. LTD. "0200M"
Note 3: product of MERCK JAPAN CO. LTD. "IRIODIN AFFLAIR 123"
Yellow pigment: Benzidine Yellow G; Red pigment: Brilliant Carmine 6B
Vehicle A: polyester resin (40), amino resin (20), solvent (30)
Vehicle B: polyester resin (20), amino resin (13), solvent (67)

TABLE 3

Results of Examples and Comparative Examples

| Examples and Comparative Examples | Ink | Apparent Viscosity of Ink at 35° C. and 100 $sec^{-1}$, poise | King of Printer | Hardness of Printing Plate, JISA Degree | Hardness of Rubber Roller, JISA Degree | Peripheral Speed Ratio of Rubber/Anilox, Vr/Va | Weight of Ink Transferred, mg/can | Printed State | Difference in Average Particle Size between Bright Pigment in Ink Layer on Can and Bright Pigment in Unused Ink |
|---|---|---|---|---|---|---|---|---|---|
| Example 1 | A | 10 | Monochromatic printer with no rubber roller | 70 | — | — | not measured | Transferability, bright feeling and image reproducibility were good. | No significant difference. |
| Example 2 | B | 8 | Monochromatic printer with no rubber roller | 70 | — | — | not measured | Transferability, bright feeling and image reproducibility were good. | No significant difference. |
| Example 3 | C | 6 | Monochromatic printer with rubber roller | 80 | 30 | 1 | 62 | Transferability, bright feeling and image reproducibility were good. | No significant difference. |
| Example 4 | C | 6 | Monochromatic printer with rubber roller | 80 | 30 | 0.91 | 35 | Bright feeling and image reproducibility were good; only ink transferred amount decreased. | No significant difference. |
| Example 5 | C | 6 | Monochromatic printer with rubber roller | 80 | 30 | 1.25 | 56 | Bright feeling and image reproducibility were good; only ink transferred amount decreased. | No significant difference. |
| Example 6 | A | 10 | Multicolor printer with no rubber roller | 70 | — | — | not measured | Transferability, bright feeling and image reproducibility were good. | No significant difference. |
| Comparative Example 1 | D | 50 | Monochromatic printer with no rubber roller | 70 | — | — | not measured | Bright feeling was good; ink accumulated on printing plate and image reproducibility was poor. | No significant difference. |
| Comparative Example 2 | A | 10 | Monochromatic printer with no rubber roller | 99 | — | — | not measured | Bright pigment accumulated on printing plate, poor bright feeling and image reproducibility decreased. | Only fine powder transferred. |
| Comparative Example 3 | C | 6 | Monochromatic printer with rubber roller | 80 | 80 | 1 | not measured | Due to transfer failure of ink from rubber roller to printing plate, the can could not be evaluated as a printed matter. | Not practiced. |
| Comparative Example 4 | C | 6 | Monochromatic printer with rubber roller | 80 | 30 | 0.45 | not measured | Due to transfer failure of ink from rubber roller to printing plate, the can could not be evaluated as a printed matter. | Not practiced. |
| Comparative Example 5 | C | 6 | Monochromatic printer with rubber roller | 80 | 30 | 2.5 | not measured | Due to transfer failure of ink from rubber roller to printing plate, the can could not be evaluated as a printed matter. | Not practiced. |

According to the printing method for printing on a can barrel of the present invention, the printing is performed in an offset system using a bright ink containing at least one bright pigment selected from aluminum flake and fine particulate coated pearl pigment, wherein a bright pigment having an average particle size of from 5 to 25 $\mu$m is selected, the bright ink is picked up by an engraving roller, the picked-up ink is fed to a printing plate directly or via a rubber roller, and the ink on the printing plate is applied onto a can barrel via a blanket wheel. As a result, the transferability of the bright ink, the bright feeling of printing and the image reproducibility can be greatly improved.

Furthermore, even in the case of using a plurality of inks having different properties such as differed viscosities, thickening or staining of the image areas or non image areas can be prevented, and a clear and high-quality multicolor printed image can be formed on the surface of a can barrel.

While the invention has been described in detail and with reference to specific embodiments thereof, it will be apparent to one skilled in the art that various changes and modifications can be made therein without departing from the spirit and scope thereof.

What is claimed is:

1. A printing method for printing an ink layer on a can barrel, which comprises picking up a bright ink having a viscosity of 20 poise or less at a temperature of 35° C. and a shear rate of 100 $sec^{-1}$ and containing at least one bright pigment having an average particle size of from 5 to 25 $\mu$m selected from the group consisting of aluminum flake and fine particulate coated pearl pigment with an engraving roller, feeding the picked-up ink on the engraving roller to a printing plate via a rubber roller, said printing plate comprising a resin-made relief printing plate having a JISA hardness of 90° or less, rotating the engraving roller and the rubber roller each at respective peripheral speeds, varying the peripheral speed of the rubber roller relative to that of the engraving roller, and applying the ink on said printing plate to a can barrel via a blanket wheel.

2. The printing method as claimed in claim 1, wherein a shape selected from the group consisting of a plurality of diagonal grooves, a plurality of micro-holes and a plurality of fine protrusions is provided on an outer surface of said engraving roller.

3. The printing method as claimed in claim 1, said method comprising forming an ink layer on the barrel without applying dampening water onto the printing plate.

4. The printing method as claimed in claim 1, which comprises disposing a multiple roll inker in the periphery of the blanket wheel and feeding pasted inks to a common blanket wheel from the printing plate of the multiple roll inker, to thereby perform multicolor printing on a can barrel.

5. The printing method as claimed in claim 1, which comprises directly feeding the picked-up ink to a printing plate.

6. The printing method as claimed in claim 1, wherein said rubber roller has a JISA hardness of 60° or less.

7. The printing method as claimed in claim 1, wherein the rubber roller has a JISA hardness of from 20 to 50°.

8. The printing method as claimed in claim 1, wherein said engraving roller and rubber roller each rotates at a respective peripheral speed, said method comprising controlling the amount of ink transferred to the printing plate by varying the ratio of the peripheral speed of the rubber roller to that of the engraving roller.

9. The printing method as claimed in claim 8, which comprises varying the peripheral speed ratio (Vr/Va) within the range of from 0.5 to 1.5, where Vr is the peripheral speed of the rubber roller and Va is the peripheral speed of the engraving roller.

10. A printing method for printing an ink layer on a can barrel, which comprises picking up a bright ink containing at least one bright pigment having an average particle diameter of from 5 to 25 $\mu$m selected from the group consisting of aluminum flake and fine particulate coated pearl pigment with an engraving roller, feeding the picked-up ink to a printing plate via a rubber roller, and applying the ink on said printing plate to a can barrel via a blanket wheel, said method further comprises rotating the engraving roller and the rubber roller each at respective peripheral speeds, and varying the peripheral speed ratio (Vr/Va) within the range of from 0.5 to 1.5, where Vr is the peripheral speed of the rubber roller and Va is the peripheral speed of the engraving roller.

11. A printing method for printing an ink layer on a can barrel, which comprises picking up a bright ink containing at least one bright pigment having an average particle diameter of from 5 to 25 $\mu$m selected from the group consisting of aluminum flake and fine particulate coated pearl pigment with an engraving roller, feeding the picked-up ink to a printing plate via a rubber roller, and applying the ink on said printing plate to a can barrel via a blanket wheel, wherein said engraving roller and rubber roller each rotates at a respective peripheral speed, said method comprising controlling the amount of ink transferred to the printing plate by varying the ratio of the peripheral speed of the rubber roller to that of the engraving roller.

* * * * *